US006216312B1

(12) United States Patent
Rowan

(10) Patent No.: US 6,216,312 B1
(45) Date of Patent: Apr. 17, 2001

(54) CLEANING APPARATUS

(75) Inventor: Denis John Rowan, Castle Hill (AU)

(73) Assignee: Aussie Red Equipment Pty. Ltd. (AU)

( * ) Notice: Subject to any disclaimer, the term of this patent is extended or adjusted under 35 U.S.C. 154(b) by 0 days.

(21) Appl. No.: 09/295,852

(22) Filed: Apr. 21, 1999

(30) Foreign Application Priority Data

Apr. 21, 1998 (AU) ..... PP3095
Oct. 1, 1998 (AU) ..... PP6277

(51) Int. Cl.[7] ..... A47L 11/30
(52) U.S. Cl. ..... 15/321; 15/385; 15/420
(58) Field of Search ..... 15/320, 321, 322, 15/353, 385, 420

(56) References Cited

U.S. PATENT DOCUMENTS

| | | | | |
|---|---|---|---|---|
| 2,801,437 | * | 8/1957 | Okun | 15/385 |
| 3,719,966 | * | 3/1973 | Lamont | 15/385 |
| 4,107,816 | * | 8/1978 | Matthews | 15/322 |
| 4,133,072 | * | 1/1979 | Face | 15/353 |
| 4,284,127 | * | 8/1981 | Collier et al. | 15/321 |
| 4,443,909 | * | 4/1984 | Cameron | 15/321 |
| 4,685,170 | * | 8/1987 | Ahlf et al. | 15/420 |
| 4,723,337 | | 2/1988 | Ellison et al. . | |
| 4,940,082 | * | 7/1990 | Roden | 15/321 |
| 4,991,254 | * | 2/1991 | Roden et al. | 15/321 |
| 5,063,635 | * | 11/1991 | Ishii et al. | 15/420 |
| 5,388,305 | * | 2/1995 | Fields | 15/385 |
| 5,711,051 | * | 1/1998 | Roden | 15/321 |
| 5,718,015 | * | 2/1998 | Rohrbacher | 15/321 |
| 5,970,574 | * | 10/1999 | Thrash | 15/322 |

FOREIGN PATENT DOCUMENTS

| | | |
|---|---|---|
| 1471595 | 7/1995 | (AU) . |
| 2148104 | 5/1985 | (GB) . |
| 9203690 | 2/1992 | (WO) . |
| 9203690 | 5/1992 | (WO) . |

* cited by examiner

*Primary Examiner*—Terrence R. Till
(74) *Attorney, Agent, or Firm*—Ladas and Parry

(57) ABSTRACT

A clean and capture tool 1 to service floor surfaces. The tool 1 includes brackets between which there extends a circular cleaning head 3. The head 3 includes an outer cover 6 below which there is located a rotatably driven arm 3 which directs water sprays at the floor surface. The cover 6 includes a downwardly facing peripheral channel 8 to which a vacuum is delivered to withdraw water and loosened dirt and waste material from the surface being cleaned.

34 Claims, 7 Drawing Sheets

CLEANING APPARATUS

FIELD OF THE INVENTION

The present invention relates to equipment for the cleaning of surfaces, particularly equipment for pressurised water cleaning of hard surfaces to remove dirt, debris and other materials from the surface.

BACKGROUND

There is a large variety of cleaning equipment used for domestic and industrial cleaning, ranging from domestic vacuum cleaners to liquid based cleaning devices. Devices for cleaning hard surfaces involve loosening dirt, grease, oil and other materials by scrubbing or the application of water under high pressure. Cleaning liquids such as solvents or detergents may also be utilised. The loosened material is usually removed by flushing with water.

One disadvantage with existing cleaning and flushing arrangements concerns the effective disposal of the loosened material. Flushing such material down open drains may offend anti-pollution regulations because of the contaminate levels in the loosened materials and waste water. There is also a considerable cost in collecting the loosened material and transporting it to a suitable waste disposal or treatment facility.

There is a commercial need for equipment which, not only effectively cleans the surface, but which also captures the loosened material and provides for proper disposal of such material.

There have been attempts at providing clean and capture devices utilising vacuum extraction and flexible sealing skirts. The effectiveness of these devices has been limited. For example, the disposition of the vacuum inlet has limited their effectiveness and versatility. In many cases, the mobility of these devices is restricted due to the provision of wheels or castors which support the weight of the device during operation. In such devices the flexible sealing skirt usually includes a brush arrangement that only partially supports the weight of the device. A further disadvantage of such devices is that they cannot effectively clean undulating hard surfaces because of the air gap beneath the brush skirt which results in the surface being left damp, thus presenting a slip hazard.

SUMMARY OF THE INVENTION

It is an object of the present invention to provide an apparatus which substantially overcomes or at least ameliorates one or more of the abovementioned disadvantages, or which at least provides the consumer with a useful choice.

In one broad form, the present invention provides a tool for liquid based cleaning of a surface, the tool having:

- a head to generally cover an area of the surface, the head including a generally downwardly facing channel to which a vacuum is applied to draw air, the liquid and material removed from the area by the tool into the channel;
- an outlet communicating with the channel and to which the vacuum is applied, the outlet being provided to direct the air, liquid and material from within the channel;
- a spray assembly to direct the liquid, under pressure, at the area to aid in loosening the material from the surface; and
- a fringe member mounted on the head and extending generally downwardly therefrom and generally surrounding the channel and area, the fringe member having formed therein a plurality of apertures through which air passes to enter a space generally enclosed by the head and the fringe member.

In another broad form, the present invention provides a system for liquid based cleaning of a surface, the system having:

- a cleaning tool;
- a water source for supplying water to at least one supply tank;
- a first supply tank for supplying water to a source of reduced pressure;
- a second supply tank for supplying water to the cleaning tool;
- a first filtering device for filtering water received from the second supply tank;
- a pressure pump for pressurising the water received from the first filtering device;
- a heating device for heating the water received from the pressure pump;
- a source of reduced pressure to recover liquid applied by the cleaning tool and material loosened from an area being cleaned;
- a waste tank assembly comprising a first separator device and a second filtering device, the first separator device for separating solid waste from the liquid and loosened material recovered from the cleaned area, the second filtering device for filtering liquid from the first separator device; and
- a waste pump for discharging the liquid from the second filtering device into a sewer.

In another broad form, the present invention provides a system for delivering liquid for cleaning of a surface, the system having:

- a tool adapted to apply liquid, under pressure, to an area to be cleaned;
- a water source;
- a supply tank for supplying liquid to the tool;
- a filtering device for filtering liquid received from the supply tank;
- a pressure pump for pressurising liquid received from the filtering device; and
- a heating device for heating liquid received from the pressure pump.

In another broad form, the present invention provides a system for recovering applied liquid and material loosened in cleaning of a surface, the system having:

- a tool adapted to recover, under reduced pressure, applied liquid and loosened material from an area being cleaned;
- a source of reduced pressure;
- a supply tank for supplying water to the reduced pressure source;
- a waste tank assembly comprising a first separator device and a filtering device, the first separator device for separating solid waste from the liquid and loosened material recovered from the cleaned area, the filtering device for filtering liquid from the first separator device; and
- a waste pump for discharging the liquid from the filtering device into a sewer.

BRIEF DESCRIPTION OF THE DRAWINGS

In order that the present invention may be more fully understood and put into practice, preferred embodiments thereof will be described with reference to the accompanying drawings, in which.

DETAILED DESCRIPTION

Figure 1:
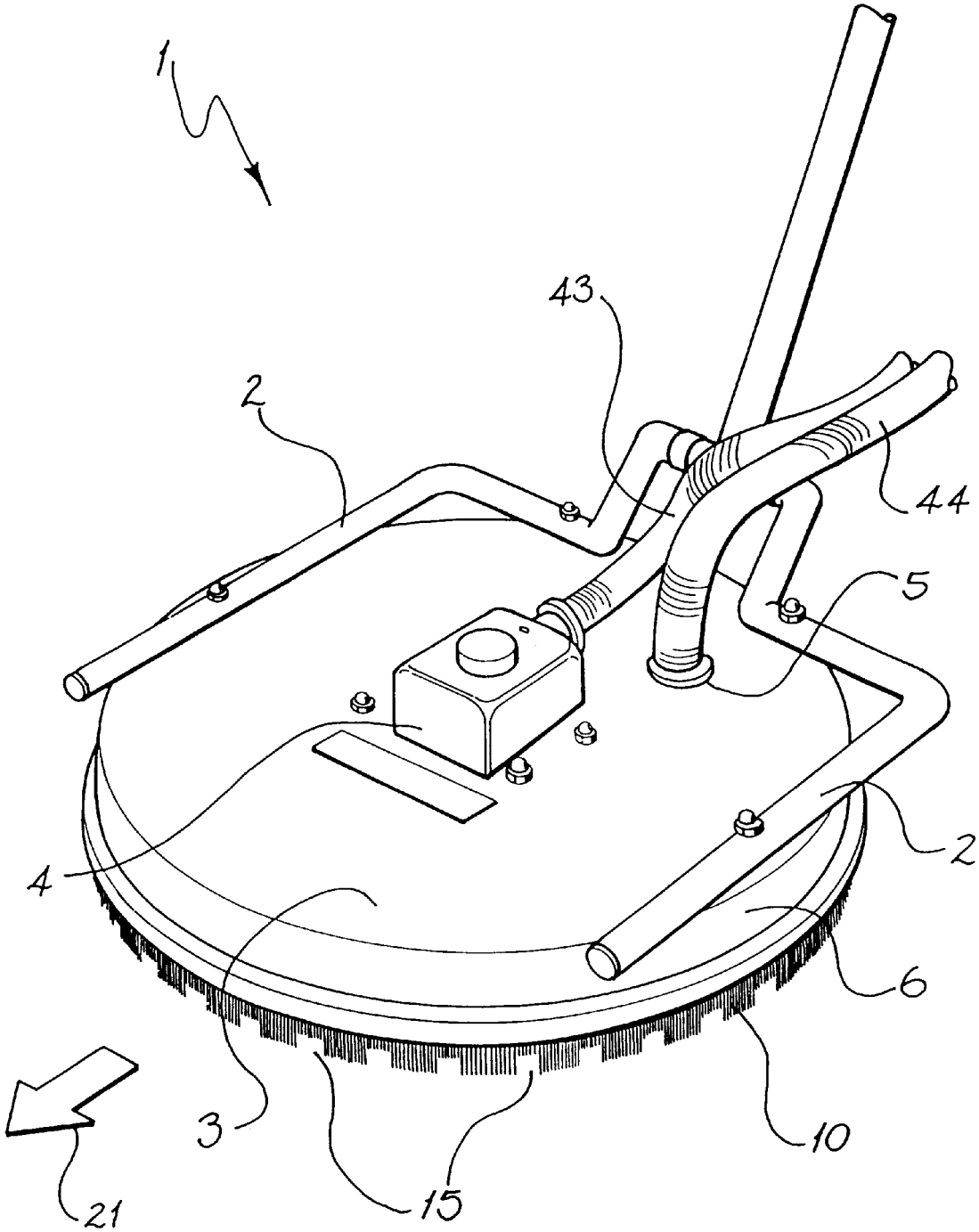
FIG. 1. is a perspective view of an operative portion of a clean and capture tool.
Figure 2:
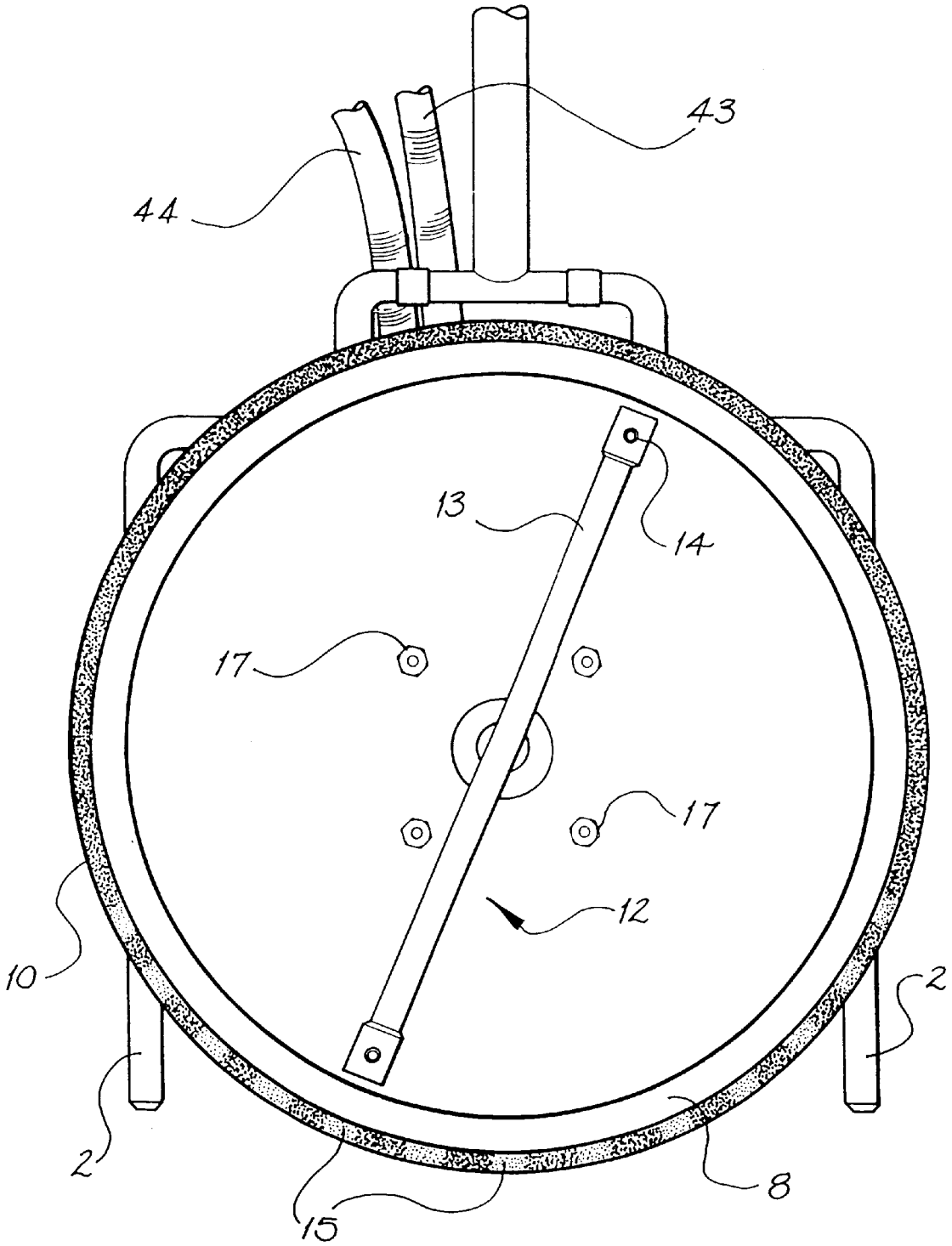
FIG. 2. is an inverted plan view of the tool of FIG. 1.
Figure 3:
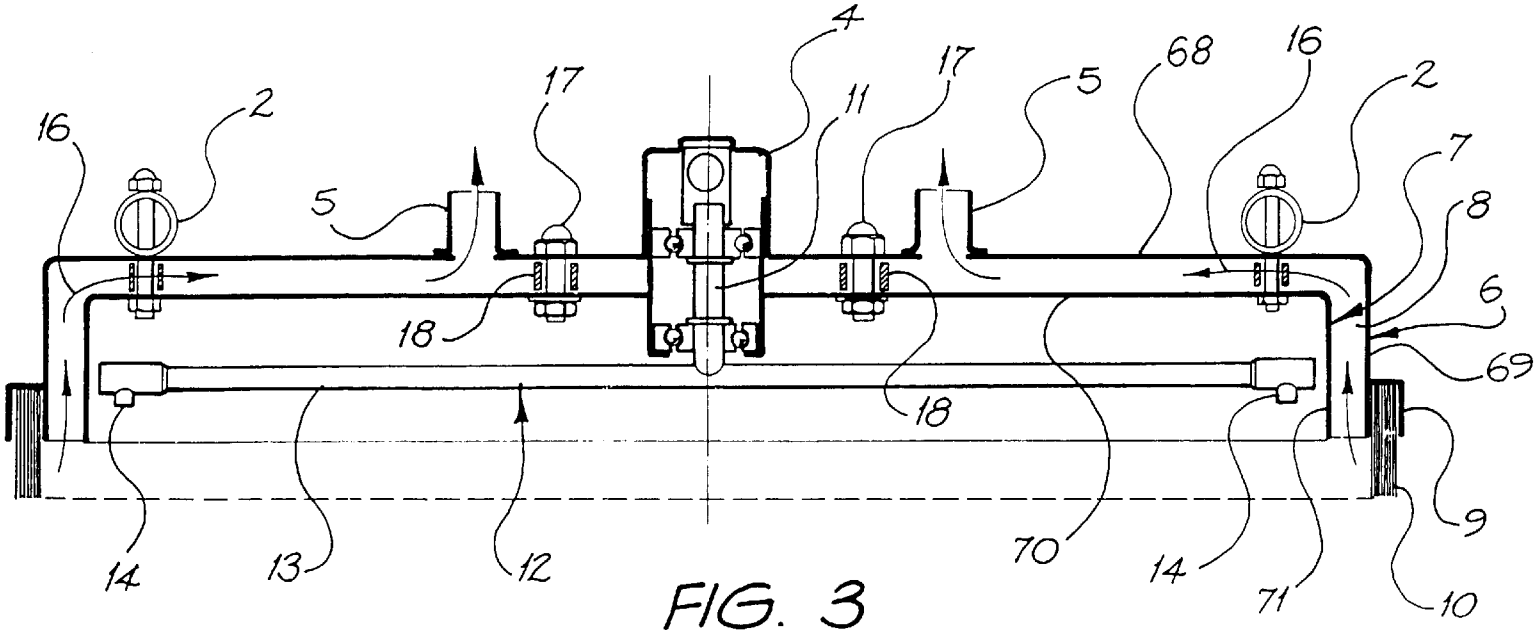
FIG. 3. is a vertical cross sectional view of the tool of FIG. 1.

FIGS. 1, 2 and 3 show a clean and capture tool 1 which has brackets 2 connected to a handle (not shown). The brackets 2 secure the handle to a generally circular cleaning head 3. The head 3 includes a liquid delivery member 4 and outlet means 5, to which a vacuum is applied.

As best seen in FIG. 3, the head 3 is formed of an outer cover 6 and inner section 7 between which a downwardly facing channel 8 is defined. The channel 8 communicates with the outlet means 5 (which may be one or more outlet ports) and acts as a passage for the transportation of loosened dirt and waste material extracted from the surface being cleaned. The outer cover 6 is generally circular in configuration so as to have a base 68 with a depending flange 69. The inner section 7 is also circular in configuration so as to have a base 70 with a depending flange 71. The flanges 69 and 71 border the downwardly facing channel 8. The bases 68 and 70 provide a cavity 72 from which the outlet means 5 extends.

The outer cover 6 and inner section 7 are each substantially inverted U-shaped in major cross-section and aligned relative to one another such that the cross sectional area of the channel 8 is substantially constant. The outer cover 6 and inner section 7 are typically made from stainless steel.

An annular skirt 9 is mounted to a lower outer edge of the outer cover 6. The skirt 9 supports a downwardly projecting fringe member 10, which contacts the surface being cleaned and provides support for the weight of the tool 1 in operation. In this case, the fringe member is an annular brush having a plurality of bristles, but it may be a blade of resilient material.

As can be seen in FIG. 3, the under surface of the inner section 7 is elevated above the surface to be cleaned. Rotatably mounted on the under surface of the inner section 7 via a coupling 11 is a spray assembly 12 which includes a hollow arm 13 with a pencil jet 14 mounted substantially near each end of the arm 13. The aperture of the pencil jet 14 may vary to suit the particular application. The arm 13 preferably spins at approximately 2,500 rpm as a result of liquid pressure and flow applied thereto. The coupling 11 is connected through the channel 8 to a liquid delivery member 4. The coupling 11 preferably utilises the VENTURI-Jet high pressure swivel manufactured by Fluid Controls Inc of Jenks, Okla., USA.

Figure 4:
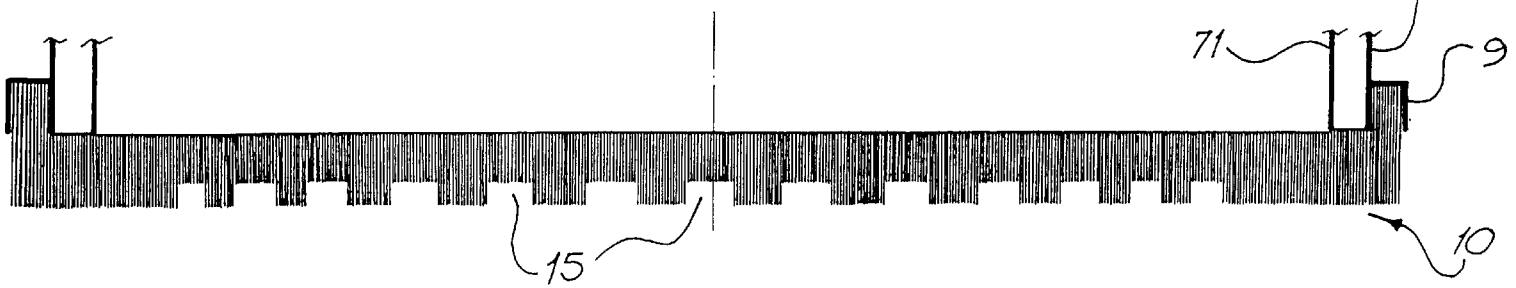
FIG. 4. is a vertical cross sectional view of the tool of FIG. 1 showing the configuration of a skirt and fringe member.

As can be seen in FIG. 4, the fringe member 10 includes a plurality of grooves or apertures 15 arranged in its lower periphery and which provide unrestricted air passages into the area beneath the outer cover 6. There are typically 12 or 13 in number of the apertures 15 which are preferably located in an arc substantially corresponding with the forward facing region of the fringe member 10. In the case where the fringe member is a brush, the apertures 15 are provided by bristles of shorter length.

The aperture 15 provides passages for air to be drawn into the channel 8 as a result of the reduced pressure being applied through the channel 8. The air passing through the apertures 15 provides for positive ventilation as indicated by the arrow 16 (best seen in FIG. 3) which acts to direct loosened dirt and materials away from the surface being cleaned into the channel 8.

As can be seen in FIG. 3, the channel 8 formed between the outer cover 6 and the inner section 7 is unitary. The outer cover 6 is mounted to the inner section 7 by a nut and bolt arrangement 17. Spacers 18 are provided to ensure a predetermined separation therebetween. In this case, the separation is approximately ¾ inch or 18.75 mm. The mixture of loosened material, air and water is drawn out of the channel 8 through two conduits 19, typically flexible hoses, mounted on the upper surface of the outer cover 6 which are connected to the outlet means 5.

Figure 5:
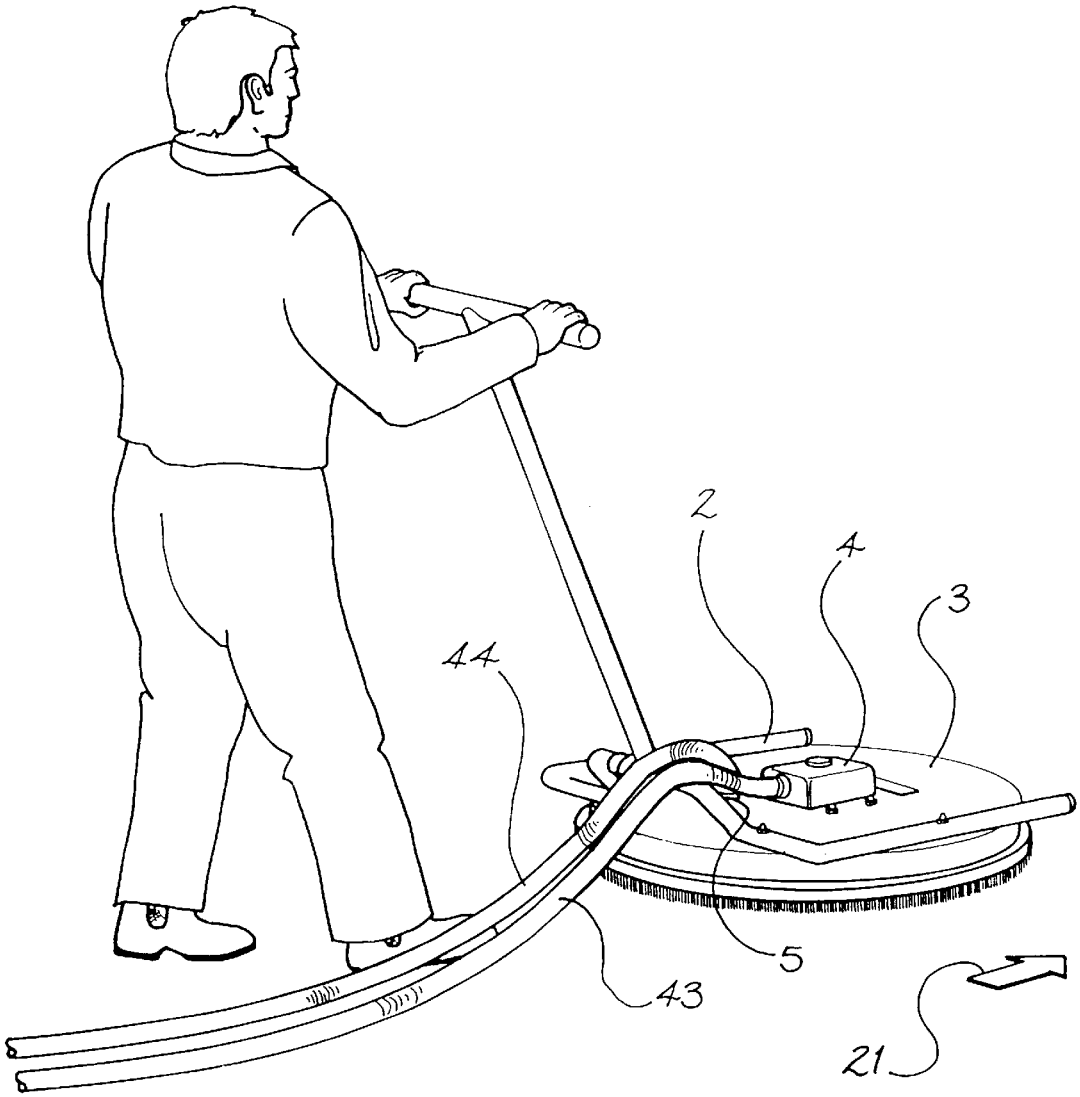
FIG. 5. illustrates the operation of the tool of FIG. 1.

As can be seen in FIG. 5, in operation the tool 1 is pushed in a forward motion in the direction of the arrow 21. The operator cleans a region of the surface and walks over the freshly cleaned region to clean another soiled region in front of the freshly cleaned region. As the head 3 is moved in a forward direction across the surface to be cleaned, the high speed jets of water or other cleaning liquids delivered through the pencil jets 14 loosen the dirt, grease, oil and the like from the surface. The loosened material and liquid is drawn into the channel 8. The apertures 15 in the fringe member 10 permit positive ventilation and prevent the escape of water and loosened material from beneath the head 3. The positive ventilation provided by the apertures 15 also assists the operative mobility and manoeuvrability of the tool 1 across the surface to be cleaned, thereby avoiding the need for wheels, castors and the like.

Figure 6:
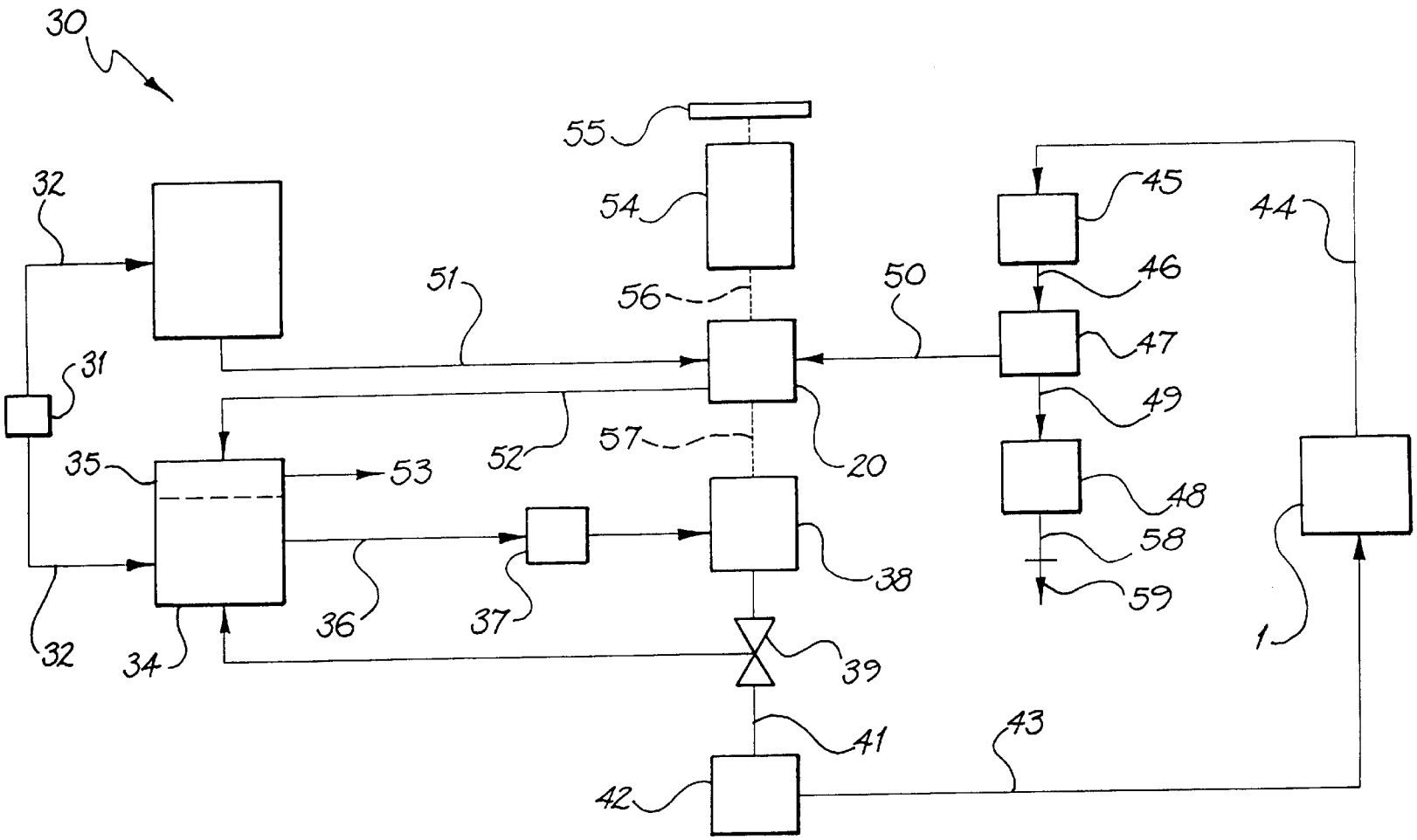
FIG. 6. is a schematic illustration showing the interrelationship between the components of a clean and capture system.

FIG. 6. shows a schematic illustration of the interrelationship between the components of one embodiment of a clean and capture system 30. The system 30 is preferably trailer mounted for mobility to enable an operator to move and use the apparatus from site to site by towing behind a vehicle.

Liquid, typically cold water, from a water source 31, such as a locally positioned faucet or hydrant, flows through inlet conduits 32, typically flexible hoses, into supply tanks 33 and 34 which, in this case, each hold approximately 25 liters of water. The supply tanks 33 and 34 include a float valve arrangement to keep the water within a predetermined level. In operation, the water level is maintained by water from the water source 31.

Water from the supply tank 34 flows through a conduit 36, typically a pipe, and is filtered by a filtering device 37 such as a JETWAVE model 2afil manufactured by Interpump Group SpA of 42040 S Ilario Reggio Emilia, Italy. Filtered water is pressurised by a pressure pump 38, such as a JETWAVE model ws202 also manufactured by Interpump Group SpA of Italy. The pressure pump 38 supplies approximately 21 liters of water per minute when operating at 1450 rpm with a maximum pressure of 200 bar. The filtering device 37 is configured to meet input requirements of the pressure pump 38. Water pressure is regulated by a pressure regulator valve 39, with bypass water being returned to the supply tank 34 by means of a conduit 40. Pressure regulated water flows through a conduit 41 to a heating device 42. One example of such a heating device is an AALADIN model 635 manufactured by Aaladin Industries Inc of Elk Point, S. Dak., USA., which enables the water to be heated to approximately 150° F. above the ambient input water temperature at 2900 psi. Extending from the heating device 42 is a conduit 43, typically an insulated flexible hose, configured to transport heated pressurised water to the tool 1. Operation of the tool 1 is as described above by reference to FIGS. 1–5.

The tool 1 is coupled to a source of air having a reduced pressure than atmosphere, in this case a power vacuum pump 20. Extending from the tool 1 is a conduit 44, typically a flexible hose, configured to transport, under reduced pressure, loosened material, air and water drawn out of the tool 1 to a waste tank assembly comprising a separator device 45 and a filtering device 47. An air hose 50 is provided to connect the filtering device 47 to the vacuum pump 20.

Figure 7:
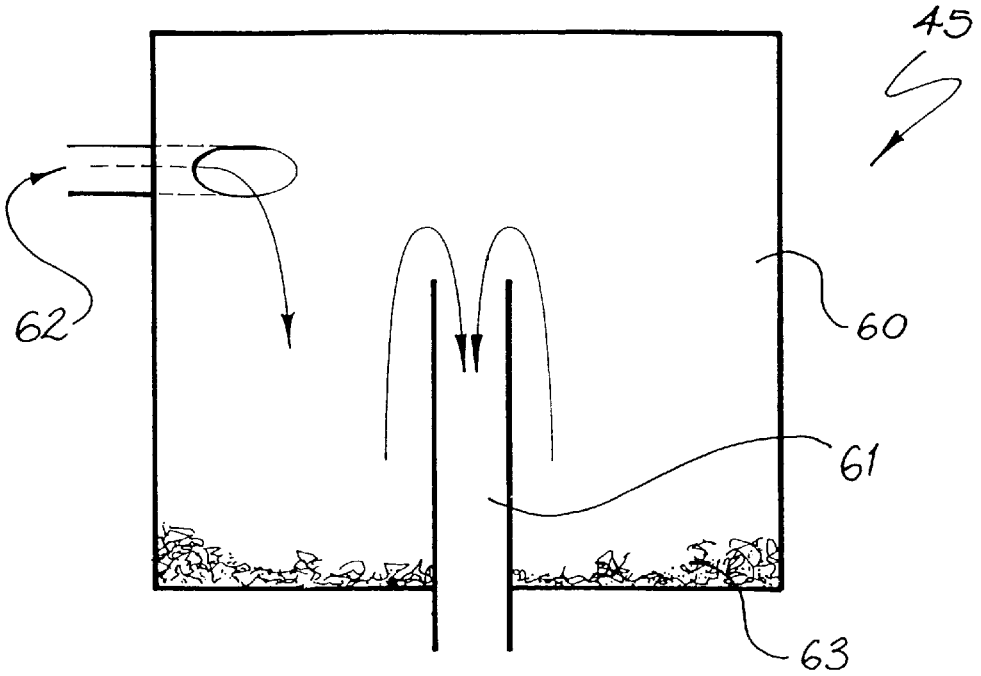
FIG. 7. is a perspective view of a separator device in a waste tank assembly.
Figure 8:
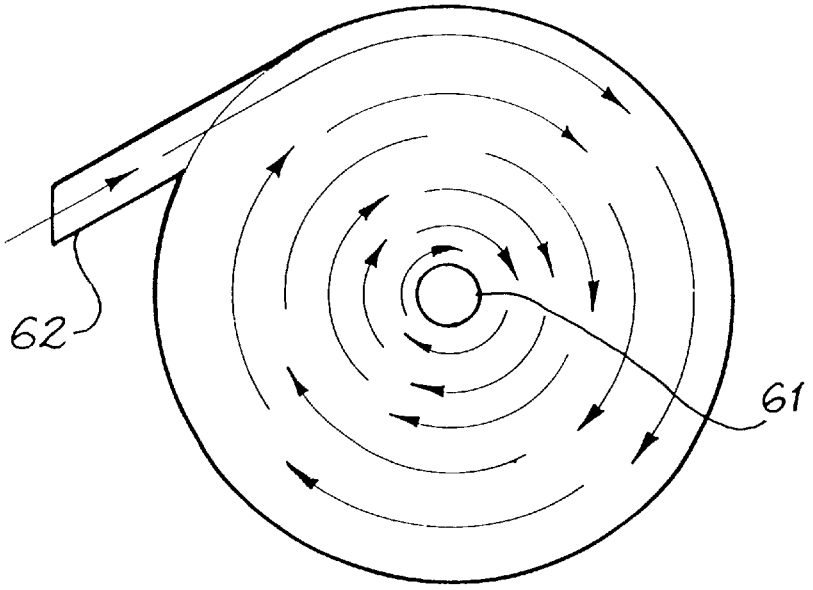
FIG. 8. is a plan view of the separator device of FIG. 7.

In this case, the separator device 45 is a cyclonic separator developed by the present inventor and is shown in FIGS. 7 and 8. The separator device 45 includes a sealed cylindrical vessel 60 with a centrally located tube 61 extending vertically to a level not exceeding that of an inlet 62. In this case, approximately 20 mm below the inlet 62. Water and loosened materials drawn out of the tool 1 is drawn into the vessel 60 through the inlet 62, which is preferably angled tangentially to cause the water to swirl inside the vessel 60 under the influence of gravity. Solids 63 sink to the bottom of the vessel 60 which causes a vertical displacement of the water which, when it reaches a level above the upper extent of the tube 61, overflows into the tube 61. The overflow is then delivered, via a conduit 46, for filtration by the filtering device 47 typically of the type manufactured by Aussie Red Carpet Equipment of Castle Hill, New South Wales, Australia.

Dirty waste water is discharged, via a waste pump 48 and conduit 59 into a sewer. The solids 63 are drained from the separator device 45 and the filtering device 47 at the completion of cleaning operations and collected in a suitable waste container for disposal, preferably at a land fill waste facility.

In this case, the waste pump 48 is a REGENT model 102rbsn manufactured by Regent Pumps of Dingley, Victoria which is of centrifugal configuration with a discharge rate of approximately 134 liters per minute. The filtering device 47 is positioned above the vacuum pump 20 and is also preferably elevated above the waste pump 48 to permit gravity feed. The filtering device 47 is connected to the waste pump 48 by a conduit 49. In this case, the conduit 49 is a wire reinforced hose. Dirty waste water is discharged into the sewer via a PVC layflat hose 58 connected to a ¾" (18.75 mm) rigid walled hose 59. Suction from the vacuum pump 20 causes the PVC layflat hose 58 to be flattened. When the waste pump 48 is running at a speed within a range of approximately 2800–3300 rpm, pressure from the waste pump 48 eventually exceeds the reduced pressure exerted by the vacuum pump 20, causing the PVC layflat hose 58 to be opened and permitting discharge of the dirty waste water into the sewer via the rigid walled hose 59.

The vacuum pump 20 is typically a centrifugal pump where an impeller rotates water within a cylinder. An example of such a pump is the type manufactured under the WATERING trade mark by Flowmax International of Ellerslie, Auckland, New Zealand. The vacuum pump 20 requires a constant water supply. In this case, approximately 4.5–6.5 liters per minute is required and supplied from the supply tank 33 via a conduit 51. The vacuum pressure created is approximately 15 inches of mercury. Water supplied to the vacuum pump 20 is compressed and heat is generated. The vacuum pump 20 discharges that heated water.

Extending from the vacuum pump 20 is a conduit 52, configured to transport air and water discharged from the vacuum pump 20 to the supply tank 34. The supply tank 34 also contains a separator device 35, typically utilising a baffle arrangement, which separates the discharged air and water. Extending from the separator outlet of the supply tank 34 is a conduit 53, typically a pipe, configured to transport discharged air into the atmosphere.

A prime mover 54, for example, a diesel motor model 4lelpw01 manufactured by Isuzu of Japan, and water cooled by a radiator 55 is provided. The prime mover 54 preferably directly drives the vacuum pump 20 via a shaft 56. The vacuum pump 20 preferably being connected to the pressure pump 38 by a pulley and belt arrangement 57.

Figure 9:
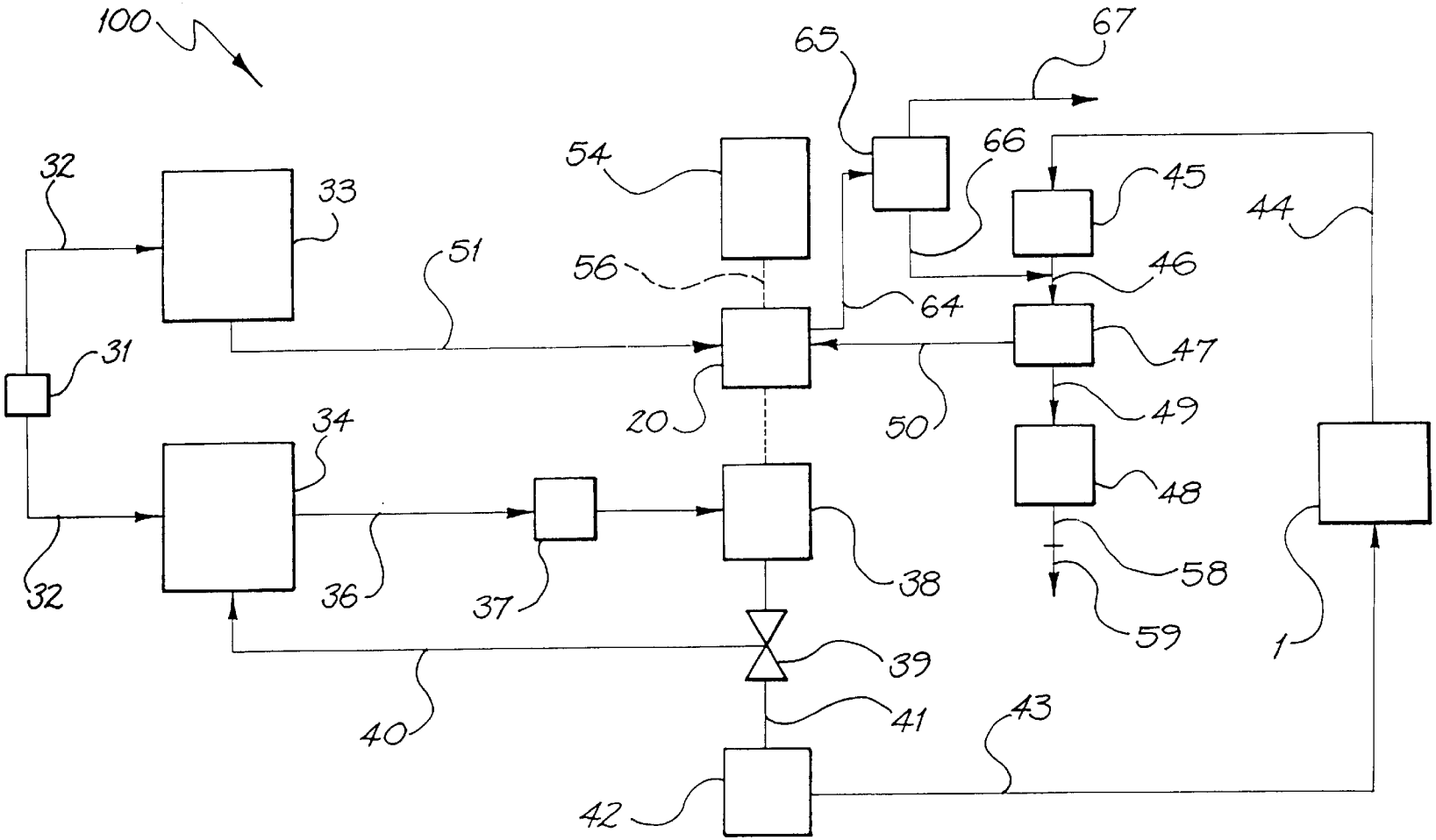
FIG. 9. is a representation similar to FIG. 6 but of an alternative embodiment.

FIG. 9 shows a schematic illustration of another embodiment of a clean and capture system 100 in which like components with the arrangement of FIG. 6 have been allocated the same reference number and to which the corresponding description applies.

In order to improve filtration and waste water discharge, a water air separator device 65 is provided. In this case the separator device 65 is of the type manufactured under the FLYNTECH trade mark by Ideal Milking Machines of 483 Mangitikei Street, Palmerston North, New Zealand.

In this embodiment, saturated air and water from the vacuum pump 20 is discharged via a conduit 64 to the separator device 65 which causes the water to fall to the bottom of the separator device 65 to be then drawn into a conduit 66 before being returned, via conduit 46, to the filtration device 47 before eventual discharge to the sewer through the waste pump 48. Saturated air separated from the water by the separator device 65 is allowed to escape to atmosphere via a conduit 67, typically a pipe. The inclusion of the separator device 65 is advantageous because it permits fine particulate (non-buoyant) matter such as sand and silt, as well as buoyant mater such as dislodged moss and other vegetable matter, to be discharged. Otherwise, as with the embodiment of FIG. 6, in the absence of regular maintenance and cleaning of the filtration device 47, this matter tends to accumulate in excess levels and may be drawn into the air hose 50 and returned, via conduit 52, to the supply tank 34 and through the pressure pump 38. This matter may cause wearing of the pressure regulator valve 39.

It can also be seen that, in the embodiment of FIG. 9, air and water is no longer returned to supply tank 34 from the vacuum pump 20 and as such the water air separator device 35 is omitted from the supply tank 34.

In yet another embodiment of the invention, the prime mover 54 is, for example, a 15 kilowatt 4 pole electric motor of the type manufactured by CMG Electric Motors of 19 Corporate Ave, Rowville, Victoria, Australia. The prime mover 54 preferably directly drives the vacuum pump 20 via the shaft 56. The vacuum pump 20 is preferably connected to the pressure pump 38 by a direct coupling.

The foregoing describes only preferred embodiments of the present invention and modifications, obvious to those skilled in the art, can be made thereto without departing from the scope of the present invention.

For example, rather than being a mobile unit, either clean and capture system 30 or 100 may be permanently installed and fitted at a site which requires regular cleaning, for example, a shopping centre or factory.

Wheels, preferably retractable, may be provided on the brackets 2. The wheels facilitate moving the tool 1 to the site to be cleaned, but would be retracted when the tool 1 is in operation.

The claim defining the invention are as follows:

1. A system for liquid based cleaning of a surface, the system having:

a mobile cleaning tool having a head to generally cover an area of surface, and a spray assembly mounted beneath the head to direct the liquid, under pressure, at the area to aid in loosening material to be removed from the surface;

a water source for supplying water to at least one supply tank;

a first supply tank for supplying water to a source of reduced pressure;

a second supply tank to supplying water to the cleaning tool;

a first filtering device for filtering water received from the second supply tank;

a pressure pump for pressurizing the water received from the first filtering device;

a heating device for heating the water received from the pressure pump;

a source of reduced pressure to recover liquid applied by the cleaning tool and material loosened from an area being cleaned;

a water tank assembly comprising a first separator device and a second filtering device, the first separator device for separating solid waste from the liquid and loosened material recovered from the cleaned area, the second filtering device for filtering liquid from the first separator device; and a waste pump for discharging the liquid from the second filtering device into a sewer.

2. A system as claimed in claim 1 wherein the liquid applied by the cleaning tool is water from the second supply tank.

3. A system as claimed in claim 1 wherein the reduced pressure source is a vacuum pump receiving a constant supply of water from the first supply tank.

4. A system as claimed in claim 1 wherein the water supplied to the reduced pressure source is recycled.

5. A system as claimed in claim 4 wherein the second tank includes a separator device for separating water and air recycled from the reduced pressure source.

6. A system as claimed in claim 1 wherein heated water and air discharged from the reduced pressure source is conveyed to a second separator device, the separated air is discharged to atmosphere, the separated water is conveyed to the second filtering device.

7. The system of claim 1 wherein said head includes a generally downwardly facing channel to which a vacuum is applied to draw air, the liquid and material removed from the area by the tool into the channel; said cleaning tool having an outlet communicating with the channel and to which the vacuum is applied, the outlet being provided to the direct the air, liquid and material from within the channel; and a fringe member mounted on the head and extending generally downwardly therefrom and generally surrounding the channel and area, the fringe member having formed therein a plurality of apertures through which air passes to enter a space generally enclosed by the head and the fringe member.

8. The system as claimed in claim 1 wherein the fringe member is located around the periphery of the head.

9. The system as claimed in claim 1 wherein the fringe member is a brush having a plurality of bristles, with the apertures being provided by bristles of shorter length.

10. The system as claimed in claim 1 wherein the fringe member is supported by a skirt mounted to the head.

11. The system as claimed in claim 1 wherein the apertures are located in the lower periphery of the fringe member.

12. The system as claimed in claim 1 wherein the apertures are located in a forward facing region of the fringe member.

13. The system as claimed in claim 1 wherein the channel is formed continuously within the periphery of the head.

14. The system as claimed in claim 1 wherein the channel is formed between an outer cover and an inner section of the head.

15. The system as claimed in claim 14 wherein the outer cover is mounted to the inner section and separated therefrom to form the channel.

16. The system as claimed in claim 14 wherein the outer cover and the inner section are each substantially inverted U-shaped in major cross-section.

17. The system as claimed in claim 14 wherein the outer cover and the inner section are each substantially circular in plan view.

18. The system as claimed in claim 14 wherein the spray assembly is rotatably mounted on an undersurface of the inner section and connected via a coupling to a liquid delivery member.

19. A system for recovering applied liquid and material loosened in cleaning of a surface, the system having:

a tool adapted to recover, under reduced pressure, applied liquid and loosened material from an area being cleaned;

vacuum pump means, comprising a vacuum pump providing a source of reduced pressure, for receiving a flow of air and water and for discharging heated water and air from the source of reduced pressure;

a supply tank for supplying water to the reduced pressure surface;

a waste tank assembly comprising a first separator device and a filtering device, the first separator device for separating solid waste from the liquid and loosened material recovered from the cleaned area, the filtering device for filtering liquid from the first separator device; and a waste pump for discharging the liquid from the filtering device into a sewer and separator means, comprising a second separator device, for separating the heated water and air discharged from the reduced pressure source, for discharging the separated air to atmosphere and for conveying the separated water to the filtering device.

20. A system as claimed in claim 19 wherein the water supplied to the reduced pressure source is recycled.

21. A system as claimed in claim 19 wherein heated water and air discharged from the reduced pressure source is conveyed to a second separator device, the separated air is discharged to atmosphere, the separated water is conveyed to the filtering device.

22. An apparatus for liquid based cleaning of a surface, said apparatus including:

a mobile tool having a head to generally cover an area of the surface and a spray mounted beneath the head to direct the liquid, under pressure, at the area to aid in loosening material to be removed from the surface;

a pump to deliver the liquid under pressure to the spray assembly; and an assembly to recover a substantial portion of the liquid and loosened material said assembly including:

a first separator connected to the tool so as to receive liquid and material therefrom, the separator being operative to separate some of the material from the liquid;

a filter connected to the separator to further remove material from the liquid;

a waste pump connected to the filter to remove liquid and material for delivery to a discharge;

a vacuum pump connected to the filter to lower the pressure therein so that air is drawn through the filter via the separator from the tool; and a second separator, the second separator being attached to the vacuum pump so as to receive air, water and material therefrom, the second separator including an air discharge, and a discharge to deliver water to said filter.

23. The apparatus of claim 22 further including a reservoir to deliver liquid to the vacuum pump.

24. The apparatus of claim 22 further including a heater to heat liquid from the pressure pump to the tool.

25. The apparatus of claim 22 further including a reservoir to deliver water to the pressure pump.

26. The apparatus of claim 22 comprising a fringe member supported by a skirt mounted to the head.

27. The apparatus of claim 26 wherein apertures are located in the lower periphery of the fringe member.

28. The apparatus of claim 26 wherein apertures are located in a forward facing region of the fringe member.

29. The apparatus of claim 22 wherein a channel is formed continuously within the periphery of the head.

30. The apparatus of claim 22 wherein a channel is formed between an outer cover and an inner section of the head.

31. The apparatus of claim 30 wherein the outer cover is mounted to the inner section and separated therefrom to form the channel.

32. The apparatus of claim 30 wherein the outer cover and the inner section are each substantially inverted U-shaped in major cross-section.

33. The apparatus of claim 30 wherein the outer cover and the inner section are each substantially circular in plan view.

34. The apparatus of claim 30 wherein the spray assembly is rotatably mounted on an undersurface of the inner section and connected via a coupling to a liquid delivery member.

* * * * *